United States Patent [19]

Hosfeld et al.

[11] Patent Number: 4,486,523

[45] Date of Patent: Dec. 4, 1984

[54] MAGNETIC TONER PARTICLES COATED WITH OPAQUE POLYMER PARTICLES TO OBSCURE COLOR THEREOF

[75] Inventors: Lewis K. Hosfeld, West Hempfield Township, Lancaster County; Ronald S. Lenox, East Hempfield Township, Lancaster County, both of Pa.

[73] Assignee: Armstrong World Industries, Inc., Lancaster, Pa.

[21] Appl. No.: 438,284

[22] Filed: Nov. 1, 1982

[51] Int. Cl.[3] ..... G03G 9/08

[52] U.S. Cl. ..... 430/106.6; 430/39; 430/137; 430/138; 430/111; 427/221; 428/407; 106/304; 106/308 M; 521/55

[58] Field of Search ..... 430/106.6, 107, 109, 430/39, 137, 138, 111; 427/221; 428/407, 403, 404, 405; 521/55; 106/308 M, 304

[56] References Cited

U.S. PATENT DOCUMENTS

| | | | |
|---|---|---|---|
| 2,890,968 | 6/1959 | Giaimo, Jr. | 430/106.6 X |
| 3,484,262 | 12/1969 | Hahn | 428/402 |
| 3,520,811 | 7/1970 | Swoboda | 430/106.6 X |
| 3,816,169 | 6/1974 | Vassiliàdes et al. | 521/55 |
| 3,824,601 | 7/1974 | Garland et al. | 430/39 X |
| 4,254,204 | 3/1981 | Kato et al. | 430/106.6 X |
| 4,443,527 | 4/1984 | Heikens et al. | 430/106.6 |

*Primary Examiner*—John D. Welsh

*Attorney, Agent, or Firm*—Laird F. Miller

[57] ABSTRACT

The present invention relates to magnetic toners and processes for producing them. The toner materials that are produced have the color of the magnetic material substantially obscured while still maintaining the high percentages of magnetic materials necessary for many types of magnetic printing processes. Further, the toners may be provided with a desired shade or color with dyes or pigments. The process of production preferably involves the coating of the individual magnetic particles with low-density essentially opaque polymeric particulate material having an affinity for the magnetic particles, thereby obscuring the color of said magnetic particles. The resulting coated particles may be intermixed with dyes, pigments, binders and other material as desired to produce toners which are useful for a variety of purposes, including multi-color reproduction techniques.

28 Claims, No Drawings

MAGNETIC TONER PARTICLES COATED WITH OPAQUE POLYMER PARTICLES TO OBSCURE COLOR THEREOF

The present invention relates to magnetic toners and, in particular, to magnetic toners in which the color of the magnetic material is obscured.

BACKGROUND OF THE INVENTION

Magnetic toners have been in existence for a number of years, but relatively little use has been made of them in the printing industry. One reason for this lack of use is the inherent dark color of the toner which is attributable to the color of the particulate magnetic material. Although magnetic printing offers certain advantages over electrostatic printing, the dark color of the particles has tended to minimize these advantages and, therefore, industry has continued to use electrostatic reproduction techniques.

THE PRIOR ART

A number of references describe processes for preparing magnetic toners. For example, U.S. Pat. No. 4,105,572 describes a ferromagnetic toner comprising at least one ferromagnetic component, a dye or chemical treating agent and a binder, the magnetic material being removable from the substrate after the dye is fixed; U.S. Pat. No. 4,218,530 discloses a toner comprising magnetic particles, a resin binder and a coating material which is a surfactant having an affinity for the magnetic particles; U.S. Pat. No. 4,230,787 discloses a magnetic toner comprising magnetic particles, thermoplastic resins and electric charge-controlling dyestuffs as the main component; and U.S. Pat. No. 4,345,013 discloses a dual purpose magnetic toner having a specific type of binder which lends itself to electrostatic reproduction techniques. In addition, background information concerning electrostatic and magnetic toners is found in U.S. Pat. No. 4,105,572, which was referred to above, and in U.S. Pat. No. 3,830,750.

Although industry has spent substantial time and effort to produce toners which are diverse in their use, all of the aforementioned references provide toners in which the color of the magnetic material is dominant, and none of the references have disclosed a method by which this problem can be avoided.

Accordingly, one objective of the present invention is to produce magnetic toners in which the color of the magnetic material is obscured.

Another objective of the present invention is to produce colored magnetic toners without detrimental interference from the presence of the magnetic material.

Still another objective of the present invention is to provide processes for producing toners having the above attributes.

These and other advantages of the present invention will become apparent from the detailed description of preferred embodiments which follow.

SUMMARY OF THE INVENTION

The present invention relates to magnetic toners and processes for producing them. The toner materials that are produced have the color of the magnetic material substantially obscured while still maintaining the high percentages of magnetic materials necessary for many types of magnetic printing processes. Further, the toners may be provided with a desired shade or color with dyes or pigments. The process of production preferably involves the coating of the individual magnetic particles with low density essentially opaque polymeric particulate material having an affinity for the magnetic particles, thereby obscuring the color of said magnetic particles. The resulting coated particles may be intermixed with dyes, pigments, binders and other material as desired to produce toners which are useful for a variety of purposes, including multi-color reproduction techniques.

DETAILED DESCRIPTION OF PREFERRED EMBODIMENTS

In one embodiment, the present invention relates to magnetic toners in which the color of the magnetic material is substantially obscured, said toners comprising magnetic particles, a coating material for said magnetic particles, and optionally, a binder, said coating material comprising essentially opague polymeric particles which have an affinity for said magnetic particles, said polymeric particles surrounding said magnetic particles and substantially obscuring the color thereof.

In a second embodiment, the present invention relates to a process for preparing a magnetic toner in which the color of the magnetic material is substantially obscured, said process comprising the steps of selecting a particulate magnetic material, coating the surface of said magnetic particles with a coating composition comprising a volatile liquid and essentially opaque polymeric particles having an affinity for said magnetic particles, optionally, intermixing a binder with the coated particles, evaporating the volatile liquid to provide a substantially dry particulate material, and pulverizing said dry material as necessary to provide a toner having a desired particle size.

Virtually any magnetic particulate material will be amenable to the practice of the present invention, provided that the resulting toner can be utilized to form a latent magnetic image. Examples of such magnetic materials are soft magnetic particles, such as carbonyl iron, and hard magnetic particles such as $Fe_3O_4$ and other iron oxides, chromium dioxide and the like.

The objective of the present invention is to coat each magnetic particle with a layer of material that is preferably of low density and which is essentially opaque, thereby obscuring the color of the magnetic particles. Densities on the order of from about 0.4 to about 1.5 g/cc are preferred for the particles of coating material. The material will also have an attraction for the magnetic particles such that when the surfaces of the magnetic particles are coated with the opaque material, the individual particles of opaque material remain essentially adhered to the surface of each magnetic particle, thereby obscuring the color thereof. Further, the coating material will retain its hiding capacity even in a dry state. Magnetic particles suitable for use in toners usually have a particle size of from about 2 to about 5 microns; therefore, a smaller particle size on the order of about 0.1 to about 3 microns for the coating material is preferred in order to adequately coat the magnetic particles and obscure their color.

Although a variety of materials may be found which will achieve this objective, one coating material which has proved to be particularly useful to achieve the desired hiding effect is Ropaque OP-42 (referred to herein as "Ropaque"), a product which is sold by Rohm and Haas. Ropaque as sold commercially is a 40% solids aqueous emulsion of hollow spheres of a polymer system comprising styrene, methyl methacrylate and butyl methacrylate. This material reportedly retains its opacity when in a dry state due to the hollow core which serves as a scattering site.

To prepare a toner of the present invention, a dispersion of the coating material is prepared in a volatile liquid. Preferably, the liquid will consist of water and, optionally, organic solvents which are compatible with water. Examples of such solvents are lower alkyl alcohols and ketones, tetrahydrofuran, and the like. Aqueous systems are preferred because the safety and toxicity problems often associated with water-immiscible organic solvents are avoided.

Once the dispersion is prepared, the particulate magnetic material is added and stirred until a substantially uniform dispersion of coated magnetic particles is obtained. The amount of magnetic material which can be added will depend on the hiding power of the coating materials; however, for a low-density coating material having good hiding power, toners comprising 50% or more (dry weight) of magnetic material can be produced. Such toners are desirable because a relatively high percentage of magnetic material is often necessary to ensure that the toner will deliver on a variety of commonly used magnetic image carriers.

The dispersed toner may be treated in a variety of ways. Thus, the suspension may be immediately dried by spray drying, by spreading the suspended material on a tray and air drying, by using heat and/or vacuum, or by other means well known in the art. Care must be taken, however, to ensure that a uniform product is obtained. Thus, it will often be desirable to increase the viscosity of the toner dispersion so that the coated magnetic particles cannot settle out. The increase in viscosity can be achieved by flocculation, or by other means which are known in the art. More information relating to the increase in viscosity will be provided below.

The toner may also be provided with a colorant which will impart a desired color to the toner. Suitable colorants may comprise pigments and dyes, examples of the latter including basic dyes, acid dyes, and the like. It must be recognized, however, that not all dyes and pigments will be compatible with a given toner system. For example, Ropaque is not efficiently colored by acid dyes. Therefore, care must be exercised in selecting a dye or pigment for use. Further, the quantity of dye used will be subject to the color level desired by the artisan.

Certain dyes which have given surprising and unexpected results when used in combination with Ropaque are the basic dyes. These dyes have not only shown a remarkable ability to dye the Ropaque but, in addition, have shown the ability to simultaneously increase the viscosity of the toner dispersion, thereby preventing the magnetic toner particles from settling out. A specific illustration of the utility of this phenomenon is provided in Example 3. While Applicants do not desire to be bound by any particular theory of operability, it appears that the increase in viscosity may be due to the nature and size of the dye cation and/or to a pH effect. Ropaque has a pH of 9-10 and the addition of the basic dye tends to reduce the pH while simultaneously increasing the viscosity. Support for this hypothesis is found in the fact that the addition of a few drops of organic or inorganic (mineral) acid to an aqueous dispersion of Ropaque and magnetic particles will give a similar increase in viscosity.

Other materials may also be included in a toner of the present invention to provide advantageous results. For example, if the toner were to be deposited on a substrate and covered with a surface film, the use of a binder would not be necessary because the film would prevent the deposited image from being smudged or removed. On the other hand, if the toner were to be used to prepare images which would be subject to wear, the presence of a binder would be desirable and perhaps necessary. Virtually any binder which is compatible with the toner system will be suitable; however, the melting character of the binder should also be considered.

Because of the manner in which a toner will typically be employed, a thermoplastic resin will usually be preferred. The melting range of such a resin will depend on the conditions to which it will be exposed and on the character of the opaque material which is used to coat the magnetic particles. Thus, if a toner is desired to be tack-free at room temperature, a binder having a thermoplastic range of from about 30° C. up to the temperature at which the opaque material loses its opacity will usually prove satisfactory. Examples of materials which have been used effectively with Ropaque are latex binders sold by Rohm & Haas under the name Rhoplex. While effective as binders, certain of these materials, such as Rhoplex MV-1 or MV-23, can also serve as protective or maintenance vehicles. As one specific illustration, carbonyl iron, which is elemental iron, tends to rust in the presence of water; yet this detrimental side effect can be eliminated or prevented by the use of protective binders containing anti-rust additives.

The present invention will be more clearly understood by reference to the following examples which are intended to illustrate, but not to limit, the scope of the present invention.

EXAMPLES

Example 1

In order to more accurately evaluate the advantages of the present invention, comparative Hunter Color Values were measured on various samples essentially as described in ASTM D-2244, "Instrumental Evaluation of Color Differences of Opaque Materials." Measurements of the Hunter Color Values were made using a MEECO Model V Colormaster colorimeter. Following are Hunter Color Values which were measured for various components and reference colors. The carbonyl iron-titanium dioxide and the $Fe_3O_4$-titanium dioxide mixtures were prepared by ball milling one-to-one mixtures of the two components prior to measuring their Hunter Color Values. In the tables below, "L" is Lightness, "a" is Red-Greeness and "b" is Yellow-Blueness.

| Substance | Hunter Color Values | | |
|---|---|---|---|
| | L | a | b |
| Anatase $TiO_2$ (duPont; Ti-Pure LW) | 93 | +1 | −1 |
| White Cardboard | 91 | +1 | +4 |
| Primary Printing Pigments | | | |
| Yellow | 88 | −17 | +80 |
| Cyan | 59 | −15 | −38 |
| Magenta | 51 | +58 | +17 |
| Carbonyl Iron (GAF; Grade G-S-6) | 55 | +9 | 0 |
| $Fe_3O_4$ (Indiana General) | 39 | +13 | 0 |
| Carbonyl Iron-$TiO_2$ (1:1) | 70 | +8 | +10 |
| $Fe_3O_4$—$TiO_2$ (1:1) | 49 | +7 | +1 |
| Dry Ropaque Spheres | 96 | 0 | 0 |
| $Fe_3O_4$-Ropaque (1:1) | 54 | +10 | −2 |

These data show inter alia that a 1:1 mixture of Ropaque and $Fe_3O_4$ is lighter and whiter than a 1:1 mixture of $TiO_2$ and $Fe_3O_4$.

Example 2

This example will illustrate the preparation of pigment-containing compositions as set forth in the present invention. The procedure which was used is as follows. To a stirred mixture of the Ropaque was added the carbonyl iron and stirring was continued until the magnetic material was thoroughly dispersed. To the stirred dispersion was then added an aqueous dispersion of very small diameter pigment, followed by the anatase titanium dioxide (if applicable). Finally, a small amount of binder was added, as applicable. The resulting mixture was formed into a film and dried at 190° F. to give a dry, fairly homogeneous substance. Little or no settling of these pigments occurred during the drying process. The dry material was then ground into a powder and sieved through a 200-mesh screen.

The following samples were prepared according to the above procedure and contained the indicated quantities of ingredients. The weight percentage of magnetic material, calculated on a dry basis, is indicated at the bottom of the table.

| | Components Grams | | | | |
|---|---|---|---|---|---|
| Ingredient | IIa | IIb | IIc | IId | IIe |
| Ropaque | 10.0 | 12.5 | 9.8 | 10.3 | 10.0 |
| Carbonyl Iron | 2.0 | 3.0 | 3.1 | 3.0 | 3.0 |
| Flavanthrone Yellow (Daniel Products Co.) | — | — | — | — | 5.0 |
| Green Gold (Harshaw Aurasperse W1061) | — | — | — | — | 0.3 |
| Naphthol Red (Harshaw Aurasperse W3022) | — | — | 3.0 | — | — |
| PCN Blue (Harshaw Aurasperse W4123) | — | — | — | 1.1 | — |
| TI-Pure LW (duPont) | — | 3.8 | 0.3 | 0.5 | 0.5 |
| Binder (Rohm & Haas Rhoplex MV 1) | — | — | — | — | 0.3 |
| Weight Percent Magnetic Material (Dry Basis) | 33.3 | 25.4 | 37.0 | 37.0 | 34.1 |

Hunter Color Values were measured for each of the samples, giving the following results.

| | Hunter Color Values | | |
|---|---|---|---|
| Sample | L | a | b |
| IIa | 57 | +10 | +4 |
| IIb | 84 | −2 | −2 |
| IIc | 59 | +42 | +19 |
| IId | 58 | +8 | −27 |
| IIe | 74 | +4 | +44 |

These results indicate that the color of the included pigments control the color of the final dry toner composition, and that the inclusion of titanium dioxide pigment raises the Hunter L value, indicating a direct effect on lightness.

Example 3

This example will illustrate the preparation of toners comprising cationic dyestuffs. The toners were prepared as follows. To a stirred quantity of Ropaque dispersion was added the magnetic material and, if applicable, a binder. Vigorous stirring was maintained for about 15 minutes after the addition was complete to ensure complete dispersion of the magnetic material. Optional whitening agents, if applicable, were also added at this point.

After dispersion was complete, the cationic dyestuff was added in a 1:1 solution of isopropyl alcohol and water. Approximately 25 ml of dye solution was added for every 100 to 150 ml of Ropaque. Sufficient cationic dye was added in all cases to cause the coated toner mixture to become extremely thick and, eventually, unstirrable. The same effect was not observed when pigments were added as described in Example 2. The pasty material was spread on a sheet and dried under vacuum at 80°-95° C. The resulting dry particulate material was collected and ground using a Mikropul ACM-1 grinder and screened through a 200-mesh screen.

The following examples were prepared and showed good color with essentially no interference from the magnetic materials. Further, these toners had higher levels of magnetic materials by weight than those prepared for Example 2. This is directly attributable to the ability of small quantities of basic dyes to dye the Ropaque. Pigments, on the other hand, must be used in greater amounts because they are not as efficient as dyes in hiding the colors of the other components.

| | Sample Content (grams) | | | | | | | | | |
|---|---|---|---|---|---|---|---|---|---|---|
| Ingredient | IIIa | IIIb | IIIc | IIId | IIIe | IIIf | IIIg | IIIh | IIIi | IIIj |
| Ropaque | 210 | 10.3 | 104 | 104 | 104 | 104 | 104 | 104 | 115 | 1000 |
| Carbonyl Iron (GAF; Grade G-S-6) | 130 | 6.5 | 37.5 | 25 | — | — | — | — | — | — |
| $Fe_3O_4$ (Indiana General) | — | — | 12.5 | 25 | 50 | 50 | 50 | 53 | 55 | 500 |
| Malachite Green (Atlantic Chemical Co.) | 2 | — | — | — | — | — | — | 0.5 | — | — |
| Sandocryl BBL Basic Red (Sandoz) | — | 0.2 | 1.5 | 4 | 4 | — | 0.3 | — | 0.2 | — |
| Victoria Blue Basic (Atlantic Chemical Co.) | — | — | — | — | — | 3.7 | — | 0.2 | — | 28 |
| Atacryl Basic Yellow 13 (Atlantic Chemical Co.) | — | — | — | — | — | — | 3.7 | 3.2 | 6.5 | — |
| Flavanthrone Yellow (Daniel Products Co.) | — | — | — | — | — | — | — | — | 10 | — |
| Aluminum Trihydrate (Paperad) | — | 1 | — | — | — | — | — | — | — | — |
| Binder (Rohm & Haas Rhoplex MV1; 46% solids) | 46 | 2.5 | — | — | — | — | — | — | — | — |
| Binder (Rohm & Haas Rhoplex MV23; 43% solids) | — | — | 18.6 | 18.6 | 18.6 | 18.6 | 18.6 | 29 | 18.6 | 186 |
| Weight percent Magnetic Material (Dry Basis) | 54.8 | 50.1 | 49.5 | 48.3 | 48.3 | 48.4 | 48.3 | 47.8 | 46.7 | 49.6 |

Hunter Color Values were measured for four of these samples giving the following results which indicated that samples comprising $Fe_3O_4$ instead of carbonyl iron were slightly darker by approximately three lightness units.

| Samples | L | a | b |
|---|---|---|---|
| IIIb | 48 | +28 | 0 |
| IIIc | 50 | +31 | +2 |
| IIId | 48 | +31 | +2 |
| IIIe | 45 | +27 | 0 |

Example 4

This example will illustrate the increase of viscosity which may be achieved by acidifying a dispersion of magnetic particles and Ropaque. A dispersion was prepared using Ropaque and $Fe_3O_4$, the dry weight ratio of the Ropaque spheres to the $Fe_3O_4$ being 1:1. To 20g of dispersion was added a few hundredths of a gram of Sandocryl BBL Basic Red dye and the mixture was stirred to give a pink color without any detectable change in viscosity. Sufficient 4M hydrochloric acid was added dropwise with stirring until the mixture became unstirrable. Upon drying and grinding the thick material as described in Example 3, a homogeneous toner was obtained having a pink cast.

This invention is not restricted solely to the descriptions and illustrations provided above, but encompasses all modifications envisaged by the following claims.

What is claimed is:

1. A magnetic toner in which the color of the magnetic material is substantially obscured, said toner comprising:

magnetic particles, a coating material for said magnetic particles, and optionally, a binder, said coating material comprising essentially opaque polymeric particles which have an affinity for said magnetic particles, said polymeric particles surrounding essentially each of said magnetic particles and substantially obscuring the dark color thereof.

2. The invention as set forth in claim 1 hereof wherein said polymeric particles are hollow and substantially spherical.

3. The invention as set forth in claim 2 hereof wherein said particles comprise a polymer system comprising styrene, methyl methacrylate and butyl methacrylate.

4. The invention as set forth in claim 3 hereof wherein said particles have a diameter of from about 0.1 to about 3 microns and a density of from about 0.4 to about 1.5 grams per cc.

5. The invention as set forth in claim 1 hereof wherein said toner comprises a colorant.

6. The invention as set forth in claim 2 hereof wherein said toner comprises a colorant.

7. The invention as set forth in claim 5 hereof wherein said colorant is a pigment.

8. The invention as set forth in claim 6 hereof wherein said colorant is a pigment.

9. The invention as set forth in claim 5 hereof wherein said colorant is a dye.

10. The invention as set forth in claim 6 hereof wherein said colorant is a dye.

11. The invention as set forth in claim 9 hereof wherein said dye is a basic dye.

12. The invention as set forth in claim 10 hereof wherein said dye is a basic dye.

13. A process for preparing a magnetic toner in which the dark color of the magnetic material is substantially obscured, said process comprising the steps of:

selecting a particulate magnetic material, intermixing said magnetic material with a coating composition comprising a volatile liquid and essentially opague polymeric particles having an affinity for said magnetic particles, said polymeric particles substantially surrounding essentially each of said magnetic particles and substantially obscuring the dark color thereof, optionally intermixing a binder with the coated particles, evaporating the volatile liquid to provide a substantially dry particulate material, and pulverizing said dry material as necessary to provide a toner having a desired particle size.

14. The invention as set forth in claim 13 hereof wherein said volatile liquid comprises water, said opaque particles are hollow and substantially spherical, and said optional binder is compatible with water.

15. The invention as set forth in claim 13 hereof comprising the additional step of intermixing a colorant with the composition comprising said coated particles and said optional binder.

16. The invention as set forth in claim 14 hereof comprising the additional step of intermixing a colorant with a composition comprising said coated particles and said optional binder.

17. The invention as set forth in claim 15 hereof wherein said colorant is a pigment.

18. The invention as set forth in claim 16 hereof wherein said colorant is a pigment.

19. The invention as set forth in claim 15 hereof wherein said colorant is a dye.

20. The invention as set forth in claim 16 hereof wherein said colorant is a dye.

21. The invention as set forth in claim 19 hereof wherein said dye is a basic dye.

22. The invention as set forth in claim 20 hereof wherein said dye is a basic dye.

23. The invention as set forth in claim 14 hereof comprising the additional step of increasing the viscosity of the composition comprising the coated particles and said optional binder whereby said particles remain substantially uniformly suspended.

24. The invention as set forth in claim 23 hereof wherein said opaque particles comprise a polymer system comprising styrene, methyl methacrylate and butyl methacrylate.

25. The invention as set forth in claim 24 hereof wherein said particles have a diameter of from about 0.1 to about 3 microns and a density of from about 0.4 to about 1.5 grams per cc.

26. The invention as set forth in claim 23 hereof wherein said increase in viscosity is achieved by adjusting the pH of said composition.

27. The invention as set forth in claim 26 hereof wherein said adjustment in pH is ahieved using an organic or an inorganic acid.

28. The invention as set forth in claim 23 hereof wherein said increase in viscosity is achieved by adding a basic dyestuff to said composition.

* * * * *